United States Patent [19]

Lee

[11] 3,962,809

[45] June 15, 1976

[54] HAND GUN HAMMER BLOCK

[76] Inventor: Joseph L. Lee, 1558 Jefferson St., Teaneck, N.J. 07666

[22] Filed: Aug. 9, 1974

[21] Appl. No.: 496,176

[52] U.S. Cl. ..... 42/66
[51] Int. Cl.[2] ..... F41C 17/00
[58] Field of Search ..... 42/66

[56] References Cited

UNITED STATES PATENTS

| | | | |
|---|---|---|---|
| 609,233 | 8/1898 | Houghton | 42/66 |
| 682,397 | 9/1901 | Wesson | 42/66 |
| 1,122,635 | 12/1914 | Pomeroy | 42/66 |
| 3,824,728 | 7/1974 | Kennedy | 42/66 |

*Primary Examiner*—Charles T. Jordan
*Attorney, Agent, or Firm*—Samuelson & Jacob

[57] ABSTRACT

A hammer block member is rotatably mounted near the path of travel of the hammer of a revolver and is biased to rotate into the hammer path of travel to prevent the hammer from reaching the point at which it will cause the discharge of the cartridge in the firing chamber of the cylinder. The cylinder advance hand contacts the blocking member and rotates it out of the hammer path of travel when the hand is raised to advance the cylinder during the firing operation of the revolver.

10 Claims, 6 Drawing Figures

HAND GUN HAMMER BLOCK

The present invention relates generally to safety devices for hand guns and, more particularly, to safety devices to block the hammer travel of a revolver.

Since the invention of the hand gun, efforts have continued to develop safety apparatus that will prevent the accidential discharge of a cartridge in the hand gun, but which will not reduce or interfere with the reliablity of the weapon to fire when properly actuated by the user. Many different approaches have been used in providing safety apparatus for revolver-type hand guns. Safety devices have been provided using a separate member to block the travel of the hammer by sliding the member either vertically or horizontally into the path of travel of the hammer.

Another approach to the safety apparatus requires that a spacing member be interposed at the end of the hammer path of travel to transmit the impact of the hammer to the firing pin used to detonate the cartridge. If the spacing member is not in the proper position, then the hammer will fail to make contact with the firing pin.

Another type of safety apparatus for revolvers operates by moving a separate firing pin member into and out of a position enabling contact of the firing pin with the cartridge to be detonated.

Safety devices using hammer blocking members are known, which rotate the blocking member into proper position rather than slide the blocking member as is the case in almost all of the previously-mentioned devices.

In one known apparatus, a hammer lift pawl actuated by the trigger moves a blocking element out of position for engaging a blocking detent on the hammer and into the position for engaging a larger firing detent on the hammer, to enable the hammer to travel until impact is transmitted to the cartridge to be detonated. However, this apparatus requires a fairly uncommon mechanism for cocking the hammer, having a relatively long hammer lift pawl on which a detent must be accurately mchined to engage the hammer and bear the force of pushing the hammer back against the main spring of the weapon. Further, the hammer must be carefully machined to provide several accurately sized and accurately located notches for engaging the hammer pawl detent and the blocking member. Any substantial wear or misalignment of the hammer, trigger, or blocking member would render the entire apparatus unreliable in either the safety mode or the firing mode of operation.

Another known apparatus employs a hammer blocking member which is rotated by actuation of the trigger. However, the apparatus is relatively complex and is mounted in the hammer and, therefore, subject to excessive amounts of shock during normal operation of the revolver, so that it is expected that this type of apparatus would be relatively unreliable.

To overcome the problems of the prior art, the present invention sets forth a hammer block safety apparatus comprising a hammer blocking member rotatably mounted in a revolver adjacent the path of travel of the hammer which is normally urged to rotate into the hammer path of travel to block the hammer. The blocking member is rotated out of the hammer path of travel by the cylinder advance hand as it is raised by movement of the trigger during the firing operation of the revolver after the cylinder has been advanced.

Accordingly, in view of the above, it is an object of the present invention to provide a simple safety apparatus, inexpensive to manufacture, and reliable to operate, having only a minimum of parts.

It is a further object of the present invention to provide a safety apparatus for a revolver which does not have to be interconnected with several other functions of the revolver, such as cylinder locks, hammer detents, or firing pins, which can only be actuated to a fire position by movement of the firing position.

Still another object of the present invention is to provide a safety apparatus for revolvers which does not require elaborate machining or very high machining tolerances in fabricating the apparatus.

Still another object of the present invention is to provide a safety apparatus for revolvers which does not require formation of detents on the components, which detents are subject to weakening and slipping, which does not require any sliding action of one part of the apparatus on the other part and provides only rotation of the parts in relation to each other during normal operation of the apparatus.

A further object of the present invention is to provide a safety apparatus for revolvers that will be relatively unaffected by wear after extended periods of time and use, and which is disposed completely within the inside workings of the revolver, so as not to be susceptible to jamming from dirt or corrosion of the parts.

It is another object of the present invention to provide a safety apparatus for revolvers which can be used on single-action or double-action revolvers and which is extremely reliable as a safety device to prevent accidental discharge of the revolver from either the cocked or the uncocked position.

Yet a further object of the present invention is to provide a safety device for revolvers which will not unblock the hammer of the revolver even if the revolver is accidentally jarred while in the cocked position; which will operate automatically and continuously and cannot be manually placed in an off or disconnected position by the user of the revolver; and which will remain in the safe position even when the hammer is cocked.

A further object of the present invention is to provide a safety apparatus for revolvers which can be used with revolvers having firing pins that are either integral with the hammer or separately mounted from the hammer.

A further object of the present invention is to provide a safety apparatus for revolvers which is actuated by the cylinder advance hand to insure that a new cartridge will not be moved into the firing position until the safety is in the off or fire position.

Yet a further object of the present invention is to provide a safety apparatus for revolvers which is extremely reliable and will not interfere with intended firing operations of the revolver; and does not interfere with the mode of operation of the firing pin and/or trigger of the revolver.

A further object of the present invention is to provide safety apparatus for a revolver which is normally totally out of contact with the hammer when in the off or fire position, and is always acting under positive spring pressure, urging the safety apparatus to the safety position whenever the trigger is not in the specific firing position.

A further object of the present invention is to provide a safety apparatus for revolvers which enables ease of assembly of the component parts of the revolver and enables removal of the cover plate of the revolver without disturbing the mechanism which includes the safety apparatus.

Other objects and advantages will be apparent from the following description of an embodiment of the invention illustrated in the accompanying drawing, in which.

Figure 1:
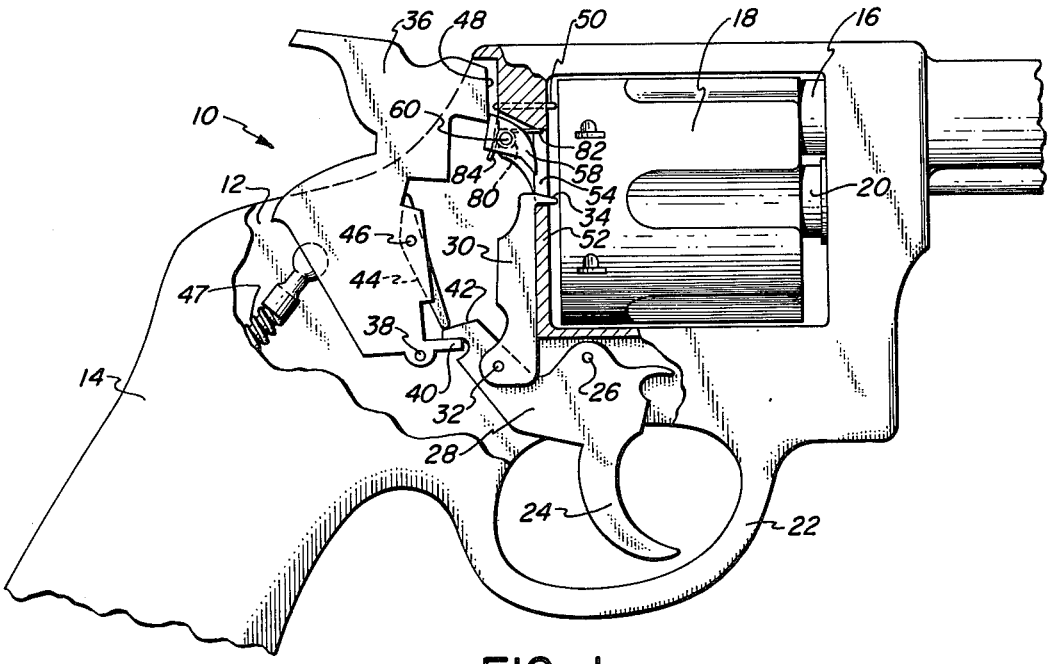
FIG. 1 is a side view, partially broken away, of a revolver with a hammer block safety apparatus constructed in accordance with the present invention.

As shown in the figures of the drawing, a revolver generally indicated at 10 has a frame 12 with a handle 14 and from which extends a barrel 16. A cylinder 18 is mounted to the frame 12 by means of a stud 20 in a conventional manner. A trigger 24 within trigger guard 22 is pivoted at pivot point 26 so that the arm 28 of the trigger extends back to coact with the cylinder advance hand 30 and the hammer 36. The hand 30 is connected to the arm 28 of the trigger by a pin 32 so that when the trigger is actuated by being moved backwards, trigger arm 28 will rise, causing hand 30 to rise. The finger 34 on the end of hand 30 extends through aperture 54 in the rear cylinder wall 52 of the frame to engage the ratchet mechanism (not shown) of cylinder 18 to rotate the cylinder in a conventional manner to bring a cartridge into alignment with the barrel for detonation by the hammer as the hammer falls in response to further movement of the trigger.

Hammer 36 is pivoted to the frame by means of pivot pin 38, and has a foot 40 which along with a sear 44 pivoted to the hammer by pin 46 coact with the shoulder 42 at the end of the trigger arm 28 to enable movement of the trigger to actuate the hammer in the standard, conventional manner, and to allow the hammer to be cocked manually.

Figure 2:
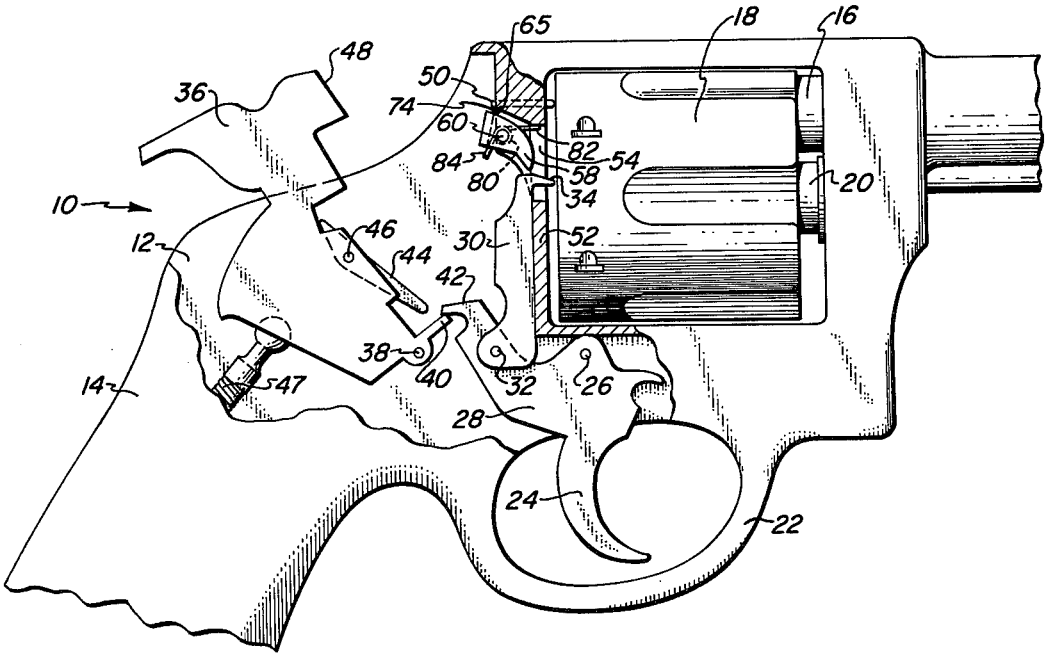
FIG. 2 is a view of the revolver shown in FIG. 1, with the hammer of the revolver in the cocked position.

When the trigger 24 is drawn back, as shown in FIG. 2, it pushes against the sear 44 to draw the hammer back and, at the same time, raises the hand 30 so as to rotate the cylinder to bring a chamber with a cartridge into position for firing.

Figure 3:
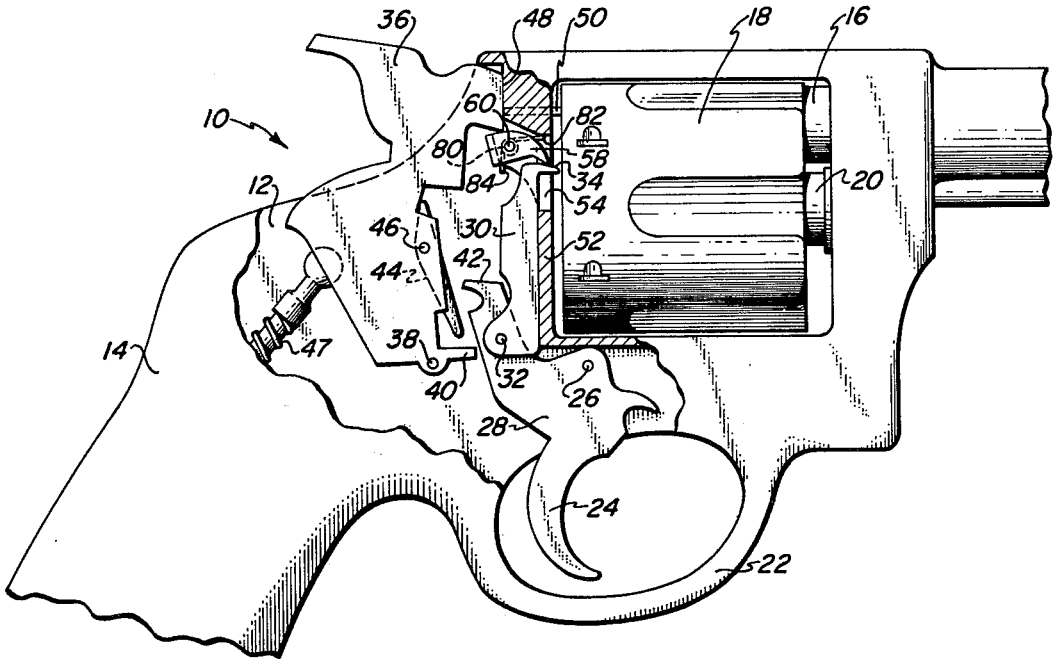
FIG. 3 is a view of the revolver shown in FIG. 1, with the hammer of the revolver in the firing position.
Figure 4:
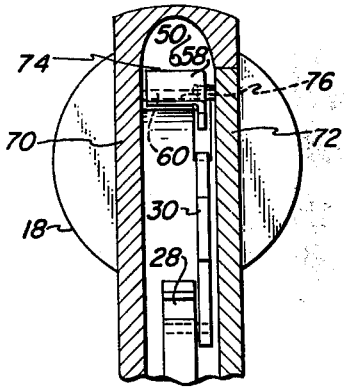
FIG. 4 is a rear view of the hammer block device shown in FIG. 2.
Figure 5:
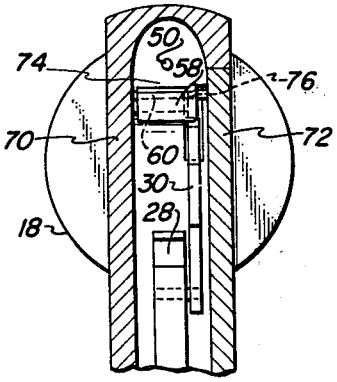
FIG. 5 is a rear view of the hammer block device as shown in FIG. 3.

As shown in FIG. 3, when the trigger is drawn further back, the trigger shoulder 42 will pass the tip of sear 44, allowing the hammer acting under the force of the mainspring 47 to fall forward, so that the striking face 48 of the hammer will contact the firing pin 50, sending the pin into the rear of the cartridge to detonate the powder charge.

All of the apparatus discussed to this point is known in the art. It is the accepted practice to use a hand connected to the rear portion of the trigger as a means for advancing the cylinder. Further, although the apparatus shown and described is a double-action type revolver, the hammer arrangement could be easily modified to make the revolver operate as a single-action weapon in which the hammer must be manually cocked before it can be released by the trigger.

Figure 6:
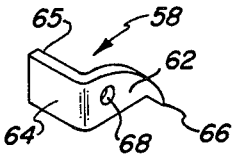
FIG. 6 is a perspective view of the hammer block member used in the apparatus shown in FIGS. 1 through 5.

The safety apparatus of the invention consists of a blocking member 58 which is pivotally mounted by means of a shaft 60 mounted in a bore 76 in the rear cylinder wall 52 of the frame and extending between the left cheek plate 70 and removable cover plate 72 such that the blocking member 58 is journalled on shaft 60. The blocking member 58 has a pivot arm 62 with a passage 68 therein by which it is mounted on the shaft 60. The blocking member 58 is somewhat L-shaped, as shown by FIG. 6, having a blocking surface 64 which runs parallel to the mounting shaft 60, and a contacting point 66 on the pivot arm 62 which is adapted to engage the top of finger 34 of hand 30, as shown in FIGS. 2 and 3. The blocking member 58 is biased by a spring 80 carried by shaft 60 and connected at one end 82 to a point on the rear cylinder wall 52 of frame 12. The other end 84 of the spring engages a convenient point on the blocking member. Spring 80 biases the blocking member to rotate in the clockwise direction, so that the top surface 65 of the blocking surface will abut the right positioning shoulder 74 of the frame. The dimensions of the shaft 60 and the blocking surface 64 are such that when the blocking member 58 is in its abutting position against positioning shoulder 74 of the frame, the blocking surface 64 will lie in the path of striking face 48 of the hammer, which path the hammer must travel in order to reach the firing pin 50. Therefore, as long as the blocking member 58 is not rotated, but is allowed to remain in its unactuated state, it is impossible for the hammer to provide an impact to any cartridge in the firing chamber of the revolver.

As shown in FIGS. 2 and 3, as the hammer is cocked, either manually or by means of moving the trigger, the hand 30 will rise to rotate the cylinder to advance the next available cartridge to the top or firing chamber position of the cylinder. As the hand rises above the cocked position shown in FIG. 2, the contacting point 66 of the blocking member 58 will come in contact with the top of finger 34 of hand 30, so that as the hand continues to rise during the final segment of the trigger travel which releases the hammer, the blocking member 58 will be rotated counterclockwise. Consequently, the blocking surface 64 will be rotated out of the path of travel of the striking face 48 of the hammer, enabling the hammer to contact the firing pin to discharge the weapon.

It should be pointed out that the hammer block safety device set forth above is an extremely simple and also an extremely reliable safety device. It, in effect, adds only three additional parts to the apparatus of the revolver, namely the blocking member, the shaft for mounting the blocking member, and a spring for biasing the blocking member. The other coacting part, namely the hand 30, serves its usual and expected function of advancing the cylinder in addition to the function of actuating the blocking member from the safety position to the fire position. Note also that the entire safety device is housed completely within the revolver so that there is little chance of corrosion or malfunctioning due to dirt catching on the mechanism. Further, there is no sliding contact between any of the parts of the safety mechanism which would tend to cause jamming or sticking of the apparatus. All parts of the hammer blocking apparatus rotate. The lack of sliding also means that there will be relatively little wear on the coacting parts used to make up the hammer block apparatus, so that malfunctioning either in the firing mode or in the safety mode of the hammer block apparatus will not occur because of worn parts, as often happens in other prior art types of safety devices. Additionally, the safety device is independent of cover plate 72 which may be removed for access without disturbing the assembled component parts of the safety device.

Note that the hammer block mechanism does not in any way coact with or interfere with the other parts of the firing apparatus, such as the firing pin or the action of the hand or hammer, as is also the case in other prior art safety apparatuses.

It will be understood that various changes in the details, materials and arrangements of parts which have been herein described and illustrated in order to explain, the nature of the invention may be made by those skilled in the art within the principle and scope of the invention, as expressed in the appended claims.

The embodiments of the invention in which an exclusive property or privilege is claimed are defined as follows:

1. In a fire arm having a frame, a hammer pivotally mounted in said frame, a trigger pivotally mounted in said frame below said hammer and coacting with said hammer to move said hammer from a cocked position to a firing position upon actuation of said trigger, a cartridge-receiving cylinder rotatably mounted in front of the hammer and hand means connected to said trigger and including a hand coacting with said cartridge-receiving cylinder to rotate said cylinder responsive to actuation of said trigger, the improvement of a hammer block safety apparatus to prevent unintentional movement of said hammer to said firing position and to allow said hammer to move to said firing position in response to actuation of said trigger, comprising:

a blocking member;

means journalling said blocking member for pivotal movement about a given axis of rotation into and out of said path of travel of said hammer adjacent to said path of travel from said cocked position to said firing position;

means biasing said blocking member to pivotally rotate into said path of travel;

means positioning said blocking member in said path of travel; and said hand means operatively connected to said trigger to contact said blocking member and pivotally rotate said blocking member out of said path of travel of said hammer upon actuation of said trigger for moving said hammer from said cocked position to said firing position.

2. A fire arm according to claim 1, wherein said means journalling said blocking member comprises:

a cheek plate in said frame;

an opposite cover plate in said frame;

a shaft extending between said cheek plate and said cover plate, transverse to said path of travel of said hammer to locate said given axis of rotation transverse to said path of travel; and means connecting said blocking member to said shaft.

3. The fire arm according to claim 2, wherein said blocking member comprises:

a blocking surface transverse to said path of travel of said hammer;

a pivot arm transverse to said blocking surface; and means connecting said pivot arm to said shaft.

4. The fire arm according to claim 3, wherein said blocking member further comprises a contacting point on said pivot arm remote from said blocking surface adapted to contact the top of said hand when said hand moves in response to actuation of said trigger.

5. The fire arm according to claim 2, wherein said means biasing said blocking member to rotate into said path of travel of said hammer comprises:

a shaft retaining bore in said frame for rotatably supporting said blocking member on said shaft; and spring means connected to said shaft and said frame to urge rotation of said blocking member.

6. The fire arm according to claim 2, wherein said means positioning said blocking member in said path of travel comprises a positioning shoulder projecting from said frame, said positioning shoulder dimensioned to intercept a surface of said blocking member in its path of rotation about said shaft.

7. The fire arm according to claim 1 wherein:

said blocking member comprises:

a blocking surface transverse to said path of travel of said hammer;

a pivot arm transverse to said blocking surface, connected to said means to rotatably mount said blocking member; and contacting point means on said pivot arm adapted to contact said hand means; and said hand means comprises:

a top surface adapted to contact said contact point of said pivot arm of said blocking member; and said hand means connected to said trigger so as to rise upon actuation of said trigger to contact said contact point of said blocking member to rotate said blocking member out of said path of travel of said hammer.

8. The fire arm according to claim 7, wherein said means journalling said blocking member comprises:

a shaft extending transverse to said path of travel of said hammer and connected to the frame of said fire arm; and means connecting said blocking member to said shaft.

9. The fire arm according to claim 8, wherein said means biasing said blocking member to rotate into said path of travel of said hammer comprises:

a shaft retaining bore in said frame adapted to rotatably support said blocking member on said shaft; and spring means connected to said shaft and said frame to urge rotation of said blocking member.

10. The fire arm according to claim 1 wherein:

said means journalling said blocking member comprises:

a cheek plate in said frame;

an opposite cover plate in said frame; a shaft extending between said cheek plate and said cover plate, transverse to said path of travel of said hammer; and means connecting said blocking member to said shaft;

said blocking member comprising:

a blocking surface transverse to said path of travel of said hammer;

a pivot arm transverse to said blocking surface;

means connecting said pivot arm to said shaft; and contacting point means on said pivot arm remote from said blocking surface, adapted to contact the top of said hand when said hand is moved in response to actuation of said trigger;

said means biasing said blocking member to rotate into said path of travel comprises:

a shaft retaining bore in said frame for rotatably supporting said blocking member on said shaft; and spring means connected to said shaft and said frame to urge rotation of said blocking member;

said means positioning said blocking member in said path of travel comprise a positioning shoulder projecting from said frame, dimensioned to intercept the blocking surface of said blocking member in its path of rotation about said shaft;

said hand means comprise a top surface adapted to contact said contact point of said pivot arm of said blocking member; and said hand means connected to said trigger so as to rise upon actuation of said trigger to contact said contact point of said blocking member to rotate said blocking member out of said path of travel of said hammer.

* * * * *